United States Patent [19]

Sunderhaus

[11] Patent Number: 4,557,302

[45] Date of Patent: Dec. 10, 1985

[54] RETAINER RING FOR THE SPOUT OF A FLUID DISPENSING NOZZLE

[75] Inventor: Charles A. Sunderhaus, Hamilton, Ohio

[73] Assignee: Dover Corporation, New York, N.Y.

[21] Appl. No.: 331,572

[22] Filed: Dec. 17, 1981

[51] Int. Cl.[4] ..... B67C 3/34; B65B 3/18

[52] U.S. Cl. ..... 141/207; 141/392; 285/415; 411/5

[58] Field of Search ..... 141/392, 311 R, 367, 141/368, 382–386, 4–8, 206–229, 37–66; 285/276, 415, 384, 385, 388, 4, 2, 3, 305, 404; 411/5, 3, 2, 295, 248, 247, 246, 517, 353

[56] References Cited

U.S. PATENT DOCUMENTS 2,257,895 10/1941 Woodford et al. ..... 285/415
3,512,447 5/1970 Vaughn ..... 411/5
4,003,415 1/1977 Lasater ..... 141/59
4,286,635 9/1981 McMath ..... 141/98

*Primary Examiner*—Houston S. Bell, Jr.
*Attorney, Agent, or Firm*—Kinney & Schenk

[57] ABSTRACT

A fluid dispensing nozzle has a retainer secured onto its peripheral surface of the nozzle's discharge spout. This retainer extends radially outward from the spout and is designed to engage a radially inwardly extending lip about a fill tank opening to secure the spout in the fill tank opening when the nozzle is operated in an automatic mode. The retainer is secured onto the spout by an annular groove in the spout and a retainer ring fitted in the groove. The retainer is abutted against the retainer ring and means are provided to prevent axial movement of the retainer relative to the spout once the retainer is so abutted.

14 Claims, 7 Drawing Figures

RETAINER RING FOR THE SPOUT OF A FLUID DISPENSING NOZZLE

BACKGROUND OF THE INVENTION

Fluid dispensing nozzles, such as those used to dispense gasoline into vehicle fill tanks in gasoline service stations, generally include discharge spouts which extend outwardly from the nozzle body and are inserted into an opening in a vehicle fill tank. It has become common practice to employ radially outward extending retainers on the outer periphery of these spouts. The retainers engage a radially interiorly extending lip of the fill tank opening to oppose gravitational forces and to hold the nozzle spout in the fill tank opening when the nozzle is operated in an automatic fill mode.

When dispensing gasoline into a vehicle fill tank, such as an automobile or the like, it is common practice to prevent the escape of gasoline vapors through the opening in which the spout of the dispensing nozzle is inserted by sealing the opening from the atmosphere and withdrawing and recapturing the vapors by use of vapor recovery systems. Such vapor recovery systems commonly include a flexible bellows or shroud which surround the spout in spaced concentric relationship thereto. An annular passageway is formed between the discharge spout and the bellows and this passageway is used to withdraw gasoline vapor from the dispensed gasoline and to prevent undue pollution of the atmosphere.

The bellows type shroud has a sealing disc on its end proximal to the discharge end of the spout, which sealing disc sealingly engages the end of the fill pipe when the spout is inserted therein. This disc is biased against the end of the fill pipe by a spring which surrounds the spout interiorly of the shroud. When the spout is inserted into the fill pipe, the force produced by this spring tends to urge the spout out of the fill pipe and renders it difficult to operate the nozzle in an automatic fill mode. Thus, when a nozzle with a vapor recovery system is used, the use of such a retainer is especially advantageous as the retainer engages a radially interiorly extending lip of the fill tank opening to oppose tne force produced by the spring. The retainers are generally disposed about three inches from the discharge end of the spout and have a radially extension of approximately $\frac{1}{8}$ inch or more. When inserted in a fill pipe, the weight of the dispensing nozzle will tend to cock the spout relative to the fill tank so as to engage the radially outward extending retainer with the radially inwardly extending lip of the fill tank opening.

Present day retainer rings used to hold dispensing nozzles into fill tank openings generally include a rolled groove positioned approximately three inches from the discharge end of the spout with a brass ring disposed about the groove and secured in position by a pair of set screws. Unfortunately, experience has shown that many of these retaining rings fall off of the spout after extensive use. Furthermore, it was often necessary to tighten the set screws every couple of days during periods of heavy use.

In making a retainer ring for the purpose of selectively securing a dispensing nozzle in a fill tank opening, it is necessary to make the ring such that its outside diameter is small enough to fit through the opening in the smallest fill tank into which it will be inserted. At the same time, it is necessary to make the radial outward extension of the retainer ring sufficiently large to effectively latch it into the radially inward extending lip once inserted. In order to be cost effective, it is also necessary to reduce the machining that is required of any necessary parts and to keep assembly procedures quick and simple.

It is thus an object of the present invention to provide a retainer for a spout of a liquid dispensing nozzle which has a long service life and which will not separate from the spout after long periods of heavy usage.

It is a further object of the present invention to provide a retainer for a spout of a dispensing nozzle which utilizes parts requiring only a minimal amount of machining.

It is another object of the present invention to provide a retainer for a spout of a dispensing nozzle which may be quickly and inexpensively assembled to the spout.

It is yet another object of the present invention to provide a retainer for a dispensing nozzle which does not require maintenance once assembled.

SUMMARY OF THE INVENTION

In accordance with the invention, a dispensing nozzle is provided with a nozzle body having an inlet and an outlet and a fluid passage extending therebetween. The nozzle has means for selectively establishing fluid communication between the inlet and the outlet of the nozzle body. A discharge spout is secured to the nozzle body proximal to the body's outlet for providing fluid communication between the nozzle body outlet and a location defined by the discharge end of the spout. An annular groove is formed in the discharge spout extending about the discharge spout's peripheral surface. A retaining ring is fitted in this annular groove and when so fitted extends radially beyond the spout's peripheral surface. A retainer is also fitted about the spout and abutted against the retaining ring. Means are also provided for preventing axial movement of the retainer relative to the spout.

In accordance with a further and specific aspect of the invention, the retainer is fitted over the retaining ring.

In a further specific aspect of the invention, the retainer ring is disposed between the abutting surface of the retainer and the discharge end of the spout.

In a preferred form of the invention, the retaining ring extends radially outward from the spout by a distance in the order 0.025 inches.

According to a further aspect of the invention, a retainer nut is threadably secured to the retainer with the retainer and retainer nut being disposed on the spout on opposite axial sides of the retainer ring.

In a further aspect of the invention, the retainer has a first bore through which the spout extends and a counterbore with an internally threaded surface. The retainer nut has an exterior surface which is threaded to matingly interconnect with the interior threaded surface of the retainer. Preferably, the retainer nut is disposed on the spout between the retaining ring and the spout's discharge end.

According to another aspect of the invention, the retainer includes a bore through which the spout extends and a counterbore on each of its axial ends with the spout having two annular grooves. The diameter of one of the counterbores is greater than that of the other.

In a more specific aspect of the invention, the first of the counterbores has a diameter which is approximately equal to the diameter of the spout plus the thickness of the retaining ring, and the second of the counterbores has a diameter which is smaller than the first counterbore diameter by approximately the depth of the annular grooves.

In another aspect of the invention, the spout includes two annular grooves and the retainer includes both a primary bore through which the spout extends and a counterbore in one of its axial ends. An annular groove is also provided in the primary bore. A retaining ring is also provided which is fitted in one of the annular grooves and abutted by a shoulder formed by the counterbore. The annular groove in the bore is in registry with the other of the annular grooves in the spout and cooperates to form an enclosure for a further retaining element. A threaded hole extends radially through the retainer and into the retainer's annular groove.

In accordance with yet another aspect of the invention, a method is provided for securing a retainer onto the exterior surface of a spout of a dispensing nozzle. An annular groove is formed in the exterior peripheral surface of a spout. A retaining ring is then securely fitted into the annular groove on the spout so that the retaining ring extends radially beyond the spout's peripheral surface. A retainer and a retainer nut are then positioned on the spout on opposite axial sides of the retainer ring and are threadably secured together so as to clamp the retainer ring therebetween.

In a more specific form of the method, the retainer is axially advanced along the spout from the discharge end over the annular groove prior to fitting of the retainer ring into the annular groove.

In accordance with a still further aspect of the method, retainer and retainer nut are threadably secured together by rotating a head of the retaining nut relative to the retainer. The rotation of the head of the retaining nut relative to the retainer is continued after the retaining nut is clamped between the retainer and retainer nut to sever the head of the retainer nut from the portion of the retainer nut threadably engaged with the retainer.

In accordance with another aspect of the invention, a method of securing a retainer onto the exterior surface of a spout of a dispensing nozzle includes forming a pair of parallel annular grooves in the exterior surface of the spout with a predetermined spacing corresponding to cooperating components of a retainer. A retainer is then positioned on the spout inwardly of the pair of annular grooves with the spout extending through a bore in the retainer. A retaining ring is fitted into the outermost of the annular grooves and the retainer is axially advanced outwardly on the spout to abutting engagement with the retaining ring. A second retaining ring is fitted into the innermost of the pair of annular grooves and into abutting relationship with the retainer.

A still further aspect of the invention includes a method of securing a retainer onto the exterior surface of a spout of a dispensing nozzle in which a pair of parallel annular grooves are formed in the exterior surface of a spout with the retainer being positioned about the spout inwardly of the pair of annular grooves. A retainer ring is fitted onto the outermost of the pair of annular grooves and the retainer is axially translated relative to the spout to align the counterbore on the outer axially end of the retainer over the retaining ring. At the same time, an annular groove on the interior bore surface of the retainer is aligned with the innermost of the pair of annular grooves. A further retaining element is then inserted through a hole in the retainer communicating with the interior annular groove of the retainer to prevent inward axial movement of the retainer relative to the spout. A set screw is then inserted into the hole of the retainer communicating with the annular groove to prevent removal of the further retaining element from the aligned grooves of the retainer and the spout.

BRIEF DESCRIPTION OF THE DRAWINGS

Other objects and advantages of the invention will become apparent upon reading the following detailed description and upon reference to the drawings, in which.

While the invention will be described in connection with a preferred embodiment and procedure, it will be understood that it is not intended to limit the invention to that embodiment or procedure. On the contrary, it is intended to cover all alternatives, modifications and equivalents as may be included within the spirit and scope of the invention as defined by the appended claims.

DETAILED DESCRIPTION OF THE PREFERRED EMBODIMENTS

Figure 1:
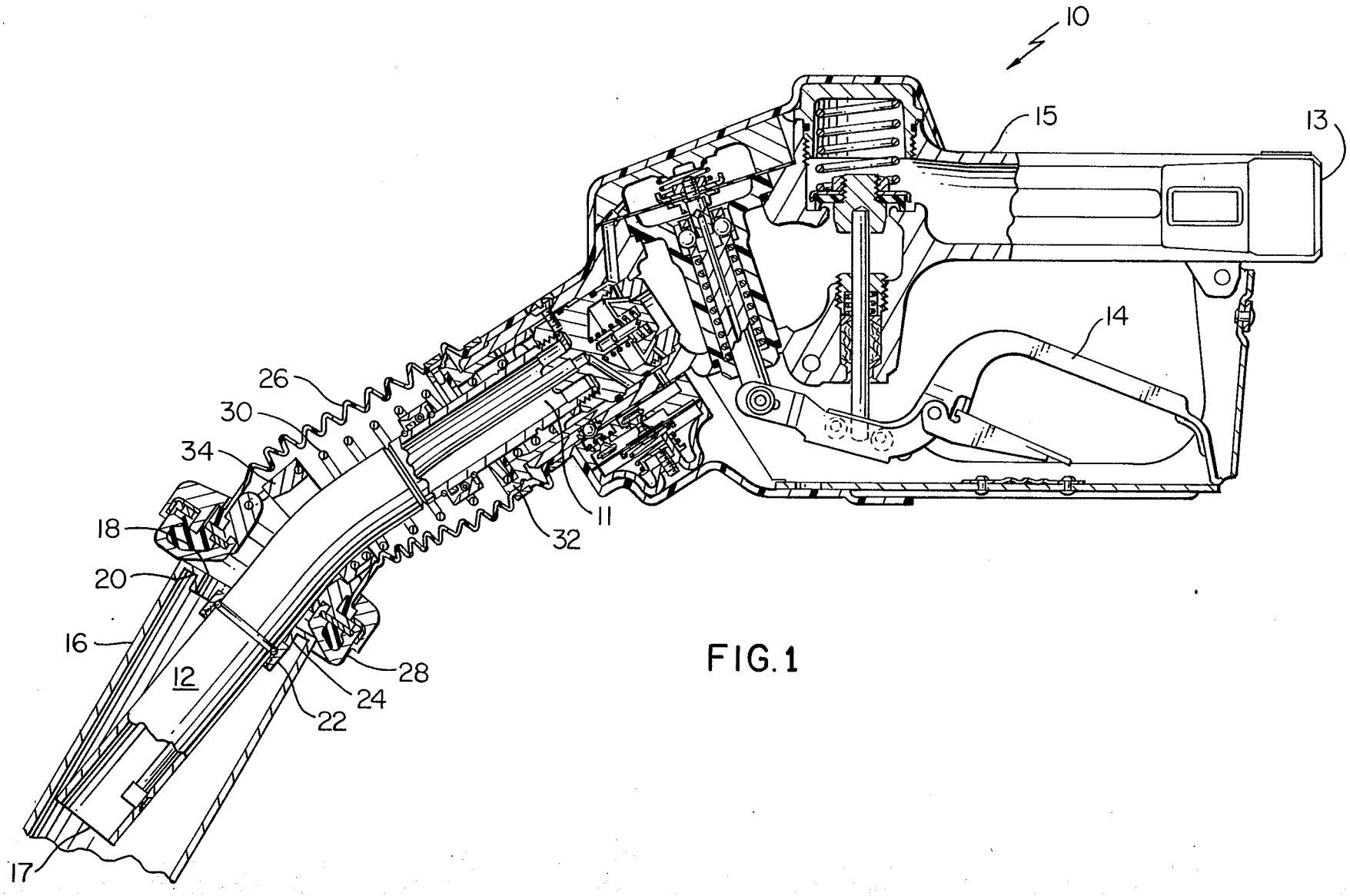
FIG. 1 is an elevational view, partially in cross section, of a gasoline dispensing nozzle having a retainer constructed in accordance with a preferred embodiment of the present invention.

FIG. 1 shows a dispensing nozzle 10 of the type generally used to dispense gasoline from a gasoline station pump into a vehicle tank or the like. The nozzle 10 includes a vapor recovery system and is generally of the type disclosed in U.S. Pat. No. 4,286,635. The nozzle 10 has a discharge spout 12 extending from a nozzle body 15. Gasoline is discharged from an outlet 11 in the nozzle body 15 whenever an internal fluid passageway to the nozzle body's (15) outlet 11 from the nozzle body inlet 13 is selectively opened by pressing an actuating lever 14 and moving it toward the nozzle body 15. Gasoline flowing through the nozzle body 15 is directed into the discharge spout 12 from which it is discharged through an opening 17 in the end of spout 12 distal to the body 15.

The spout 12 is shown in FIG. 1 as it is inserted into a fill pipe 16. The fill pipe 16, which leads to a gasoline storage tank (not shown) of an automobile or the like, has an opening 18 defined by a radially interiorly extending annular lip 20 having an axial extension 24. Spout 12 has a retainer ring 22 radially outwardly extending from its outer peripheral surface which is shown in engagement with the axial extension 24 of annular lip 20.

FIG. 1 also shows that the spout 12 is disposed within a bellows type shroud 26 which is spaced in generally concentric relationship to the spout 12. The shroud 26 extends from the nozzle body 15 and terminates short of the spout's (12) discharge opening 17 into a disc member 28. This disc member 28 is urged away from the body 15 through the agency of a compression spring 30 disposed in the annular space between the spout 12 and the shroud 26. The spring 30 also tends to keep the flexible bellows type shroud in an extended condition. The compression spring 30 extends between a check valve sleeve 32 in the body 15 to a spring retainer 34. This spring retainer is pivotally secured to the disc member 28.

As will be apparent to those skilled in the art from a viewing of FIG. 1, the disc member 28 engages and forms a seal against the axial end of the fill pipe 16 when the spout 12 is inserted into the fill pipe 16. Vapor communication is then provided between the fill tank pipe 16 and a vapor recovery system (not shown) through the nozzle 10. Specifically, a vapor recovery path is established in the annular passageway between the spout 12 and the shroud 26. This general type of a vapor recovery system is known in the art and more specifically described in the aforementioned U.S. Pat. No. 4,286,635. Since vapor recovery systems of this type are now known in the art and described in the aforementioned patent, further description thereof will be omitted in the interests of brevity.

When the spout 12 is inserted into the fill pipe 16, the disc member 28 is moved relative to the fill pipe 16 toward body portion 11, flexing the shroud 26 and overcoming the bias of compression spring 30. In the absence of some latching means to resist the force produced by spring 30, the spring 30 would urge the spout 12 out of the fill pipe 16 once the manually applied insertion force is eliminated. The nozzle could not then be operated in an automatic mode. After the nozzle spout 12 is inserted into the fill pipe 16, the weight of the nozzle, under gravity bias, or the pull of hoses connected to the nozzle 10, will cock the spout 12 relative to the fill pipe 16 so as to engage the retainer 22 with the interior end of the axial extension 24 of the lip 20. This cocked position of the nozzle 12 relative to the fill pipe 16 is illustrated in FIG. 1.

Figure 2:
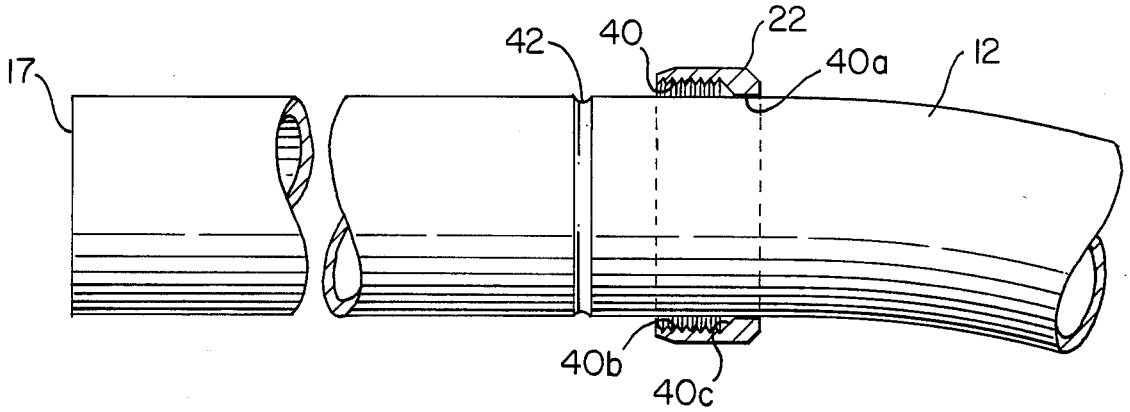
FIG. 2 is a fragmentary elevational view of the spout of the dispensing nozzle illustrated in FIG. 1 depicting the first step of assembling the retainer to the spout.

FIG. 2 depicts the discharge spout 12 isolated for clarity from all of its cooperating components, except for the retainer 22. It is seen that this retainer 22 is cylindrically shaped with an internal bore 40. The retainer 22 is slid or axially translated over the spout 12 with the spout 12 extending through the bore 40. Since the spout 12 may be secured to the body portion 15 at this time, the retainer 22 may be axially translated inwardly from the discharge end (proximal to the discharge opening 17) toward the nozzle body 15. The retainer's (22) internal bore 40 includes a first portion **40*a* with an internal diameter slightly in excess of the outer diameter of the spout 12 and a second portion with a larger threaded diameter 40*b* which is spaced from the spout 12. In the preferred embodiment, the larger threaded diameter 40*b* is disposed more proximal to the discharge end 17 of the spout 12 and the smaller diameter 40*a* is positioned more proximal to the nozzle body 15. An annular shoulder 40*c* joins the two retainer diameters, the shoulder 40*c* being angled at approximately 45° relative to the bore 40*a***.

Approximately three inches from the discharge end of the spout 12, an annular groove 42 is formed about the spout's periphery. This annular groove 42 is preferably rolled into the nozzle. However, a machined groove could also be used with equal facility. In the preferred embodiment, this groove 42 is rolled to a depth between 0.016 inches and 0.023 inches. The retainer 22 is positioned on the spout 12 adjacent the groove 42, between the groove 42 and the nozzle body 15.

Once the retainer 22 is so positioned, a retainer ring 44 is installed. This retainer ring 44 is preferably formed of hardened steel and should be formed of a material which is harder than the material from which the spout 12 is formed. In the preferred embodiment, the spout 12 was formed of aluminum. The retaining ring 44 is formed into an incomplete circular configuration with two proximally adjoining free ends and having a radius slightly in excess of the periphery of the groove 42 but less than that of the spout 12 adjacent the annular groove 42. When fitted into the spout 12, the free ends of the retainer ring 44 are further separated from their free state so as to encircle the annular groove 42 with the retaining ring 44. When the force separating the free ends of the retainer are terminated, the retainer ring 44 will return to its free state configuration, firmly fitted into the annular groove 42. The retainer ring 44 is approximately 0.060 inches in cross sectional diameter so that when fitted into the annular groove 42, slightly more than half of the retainer ring 44 extends beyond the annular groove 42.

Figure 3:
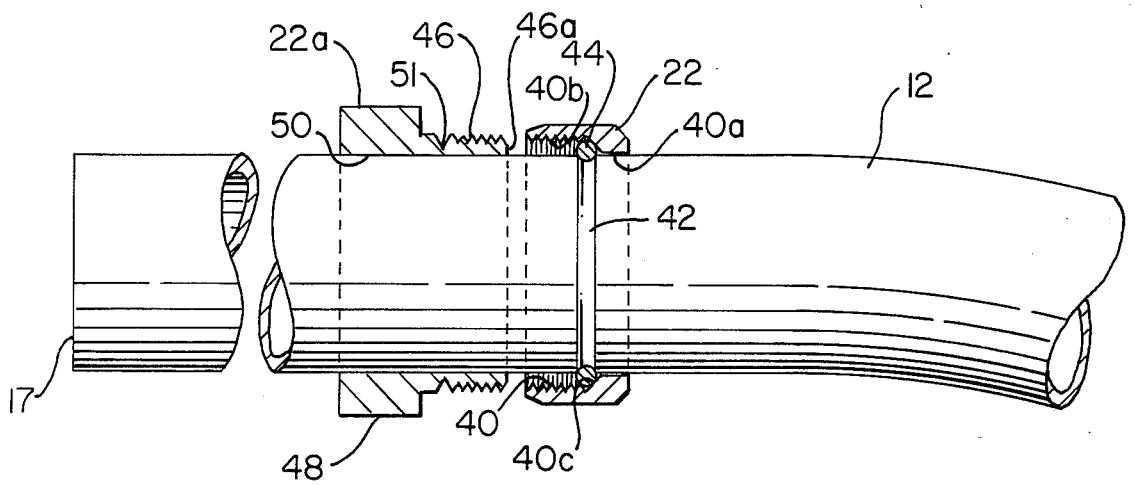
FIG. 3 is a fragmentary elevational view of the spout of the dispensing nozzle illustrated in FIG. 1, similar to FIG. 2, but illustrating subsequent steps in the assembly of the retainer ring to the spout in which a retainer ring and a retainer nut are applied.

Once the retainer ring 44 is firmly fitted into annular groove 42, the retainer 22 is slid over the spout 12 toward the discharge end 17 of the spout until the retainer 22 is over the retaining ring 44 and the 45° shoulder **40*c* on the retainer 22 is in contacting relationship with the retainer ring 44. Either before or after sliding the retainer 22 over the retainer ring 44, a retaining nut 22*a* is slid over the discharge end of the spout 12 toward the retainer 22. This retainer nut 22*a* has a first cylindrically shaped threaded portion 46 in a second hexagonally shaped head portion 48. The first cylindrically shaped portion 46 has a threaded exterior surface which matingly engages the interior threads 40*b* of the retainer 22 while the second hexagonally shaped head portion 48 has a substantially larger diameter which is adapted to be engaged by a wrench or the like for turning, as will be explained below. The retainer nut 22*a* also has a cylindrically shaped internal bore 50 which extends completely through the retaining nut 22*a*. The diameter of bore 50 is approximately equal to that of portion 40*a* of bore 40 through the retainer 22. As will be readily apparent from a viewing of FIG. 3, the retainer nut 22*a* is oriented on the spout 12 so that the cylindrically shaped threaded portion 46 is more proximally located to the nozzle body 15 than the hexagonally shaped head portion 48**.

Figure 4:
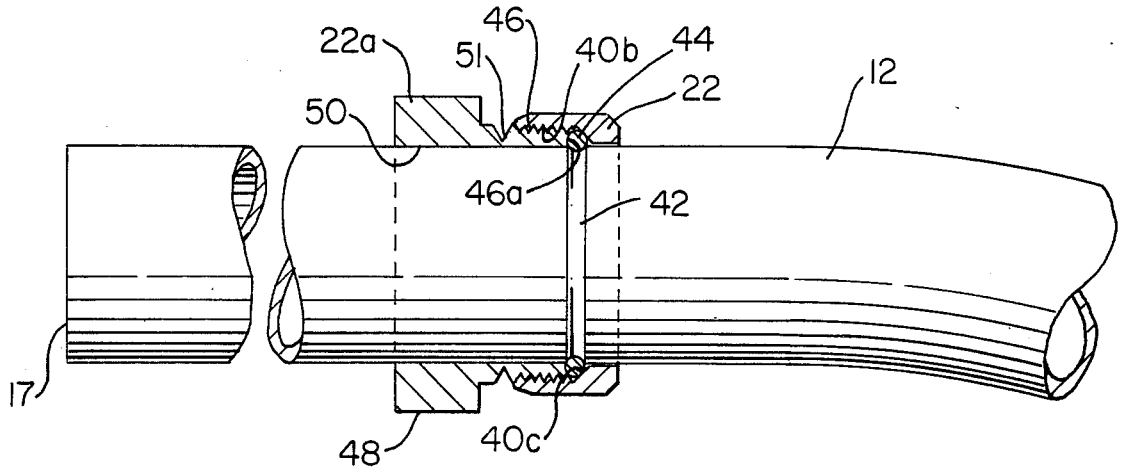
FIG. 4 is a fragmentary elevational view of the dispensing nozzle spout illustrated in FIG. 1, similar to FIGS. 2 and 3, depicting an assembled retainer prior to severing and removal of the head of the retaining nut.

In FIG. 4, the retainer nut **22*a* has been axially translated or moved along spout 12 toward the retainer ring 44 by threadably engaging the exterior threads on the cylindrically shaped portion 46 of the retainer nut 22*a* with the mating internal threads in portion 40*b* of retainer 22. The retainer nut 22*a* is so advanced by rotating the hexagonally shaped portion of the nut 22*a* with a wrench or the like until the retaining ring 44 is securely clamped between the retainer 22** and the retainer nut 22*a*. Specifically, the retainer ring 44 is clamped between the 45° shoulder 40*c* on the retainer 22 and the inward axial end 46*a* of the retaining nut 22*a* (see FIG. 3).

The cylindrically shaped threaded portion 46 and the hexagonally shaped head portion 48 of the retaining nut are separated by a torque or break-off groove 51. This break-off groove 51 is a predetermined line of weakening about the periphery of the retaining nut 22*a* which fractures at a torque level substantially below that of the rest of the retaining nut. When a predetermined torque is applied to the hexagonally shaped portion 48 after the retaining ring 44 is securely clamped between the shoulder 40*c* and the axial end 46*a*, the hexagonally shaped head 48 is separated from the threaded end portion at the break-off groove 51. After separation, the hexagonally shaped head portion 48 is removed from the spout 12 by sliding it over the discharge end of the spout and the retaining element 22 takes an appearance such as that illustrated in FIG. 1.

As most clearly apparent from FIG. 1, the principle force applied to the retaining element 22 is an axial force along the spout which tends to push the retaining element towards the discharge end of the spout 12. In order for the illustrated retainer 22 to be dislodged from its position, the axial force applied against the retainer 22 must be sufficient to extrude the entire length of the dispensing spout 12 from the retainer 22 to the discharge end 17 of the spout 12 about the periphery of the spout 12 engaged by the retaining ring 44. As will be readily appreciated, this force is rather significant.

This retainer 22 is extremely difficult to remove and requires virtually zero maintenance. With the retainer ring 44 locked in the annular groove 42 and the retainer 22 and threaded portion 46 of the retainer nut 22*a* firmly locked together, there is no relative movement between the retainer 22 and the spout 12. It is also possible to reverse the positioning of the retainer 22 and the retainer nut 22*a* so that the retainer 22 is more proximal to the discharge end 17 of the spout 12. However, it has been discovered that the wearing surface of the retainer 22 is superior to that of the joined surfaces of the sheared surface of the retaining nut 22*a* and the opposite axial end of the retainer 22.

Figure 5:
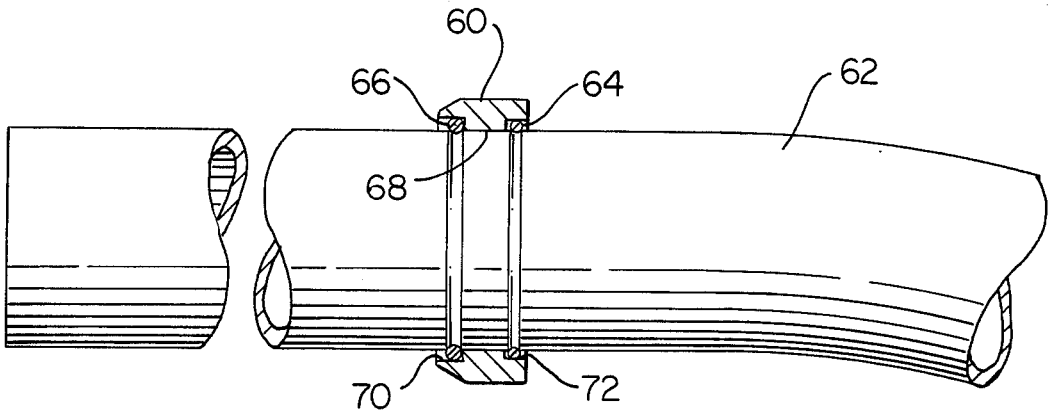
FIG. 5 is a fragmentary elevational view of a dispensing nozzle spout depicting a second embodiment of a retainer.

FIG. 5 depicts another embodiment of a similar retainer 60. The retainer 60 is shown fitted on a discharge spout 62. Although not specifically illustrated in FIG. 5, the spout 62 is attached to the dispensing nozzle body 15 in a manner which is identical to that of spout 12 previously described. The second embodiment has two retainers, inboard retainer 64 being more inwardly disposed (more proximal to the nozzle body 15) than outboard retainer 66. Rolled or machine grooves are disposed on the spout 62 beneath these illustrated retainers 64 and 66 in the same manner as groove 42 is disposed beneath retaining ring 44 in the previously described embodiment.

The assembly of retainer 60 is, in many ways, similar to that of retainer 22. Initially, inboard retaining ring 64 is fitted onto the spout 62 to a position inward of its underlying annular groove. The retainer 60 is then also slid along the spout 62 from the discharge end to a position inwardly of the annular groove disposed beneath annular retaining ring 64 in the illustration of FIG. 5. With retainer 60 so positioned, the outboard retaining ring 66 is fitted into its underlying annular groove. The retainer 60 is then moved axially inward toward the discharge end of the spout 62 to a position abutting against the fitted retaining ring 66. Retaining ring 64 is then axially moved to a position above its underlying annular groove where the radially inward bias of the ring causes it to constrict radially from its stretch position about 62 to a securely fitted relationship with the underlying annular groove. This fitted position of retaining ring 64 is also illustrated in FIG. 5.

As seen in FIG. 5, the retainer 60 has a primary through bore 68 with counterbore 70 and 72 on opposite axial ends of the bore 68. The primary bore 68 has a dimension which is slightly greater than that of the spout 62 to prevent axial sliding of the retainer 60 upon the spout 62. Each of the counterbores 70 and 72 has a diameter which is larger than that of the bore 68. Counterbore 70 has a diameter that is just slightly larger than that of the retaining ring 66. The diameter of counterbore 72 exceeds that of counterbore 70 by an amount approximately equal to the depth of the annular grooves underlying the retaining ring 64 and 66. In the illustrated embodiment, the bore 68 has a diameter of approximately 0.945 inches, with counterbore 70 having a diameter of approximately 1.060 inch and counterbore 72 having a diameter of approximately 1.085 inch.

The majority of force applied to retainer 60 in operation (in the order of approximately 90 percent) is applied against the retaining ring 66. The two retaining rings 64 and 66 prevent the retainer 60 from axially moving on the spout 62 in either direction. This second described embodiment may be easier and quicker to assemble than the first and is economically advantageous in that it only has one machine part. It has been found, however, that after heavy duty field service, it was possible to create a wear spot interiorally adjacent to the retaining ring 64. If wear at this location were to exceed the depth of the groove (approximately 0.023 inches) underlying retaining ring 64, it would be possible, under certain conditions, that the retainer ring 64 might be moved axially inward, permitting the retainer 60 to move about spout 62.

Figure 6:
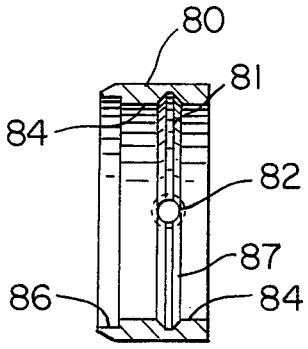
FIG. 6 is a cross sectional elevational view of a third embodiment of a retainer constructed in accordance with the present invention.
Figure 6A:
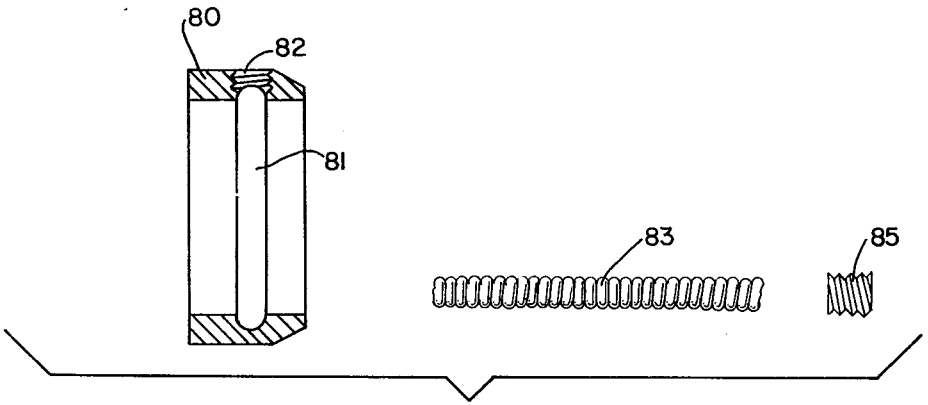
FIG. 6A is a detailed exploded view of the retainer ring, the garter spring and set screw of FIG. 6.

Another embodiment of a retaining assembly is illustrated in FIGS. 6 and 6*a*. This illustrated retaining assembly is adapted for use on a dispensing spout, such as spout 12 in FIG. 1. This embodiment includes one machined retainer 80, one retainer ring 81 and one garter spring 83. The garter spring 83 is held in place with a set screw 85. In assembling retainer 80, the retainer 80 is axially moved on the spout from the discharge end of the spout over a pair of spaced annular grooves in the spout. These annular grooves are identical to the annular grooves in the first illustrated embodiment. When the retainer 80 is so positioned, a retainer ring 81 is fitted into the annular groove on the spout proximal to the spout's discharge end and the retainer 80 is moved axially outward along the spout to abut and cover the fitted retainer ring. The retainer 80 also includes a tapped hole 82 which communicates through the retainer 80 with another annular groove in the spout. A garter spring 83 is then fed through the tapped hole 82 and about the underlying annular groove in the spout until the garter spring 83 is completely inside the retainer 80. A set screw 85 is then placed in the tapped hole 82 to prevent the garter spring 83 from backing out. It will be noted that the retainer 80 has an internal bore 84 with a counterbore 86 on its axial end proximal to the spout outlet. This counterbore 86 has a diameter which is slightly in excess of the retaining ring fitted into the outboard annular groove so that the retainer 80 may be axially advanced over the retaining ring when the retaining ring is fitted in its underlying annular groove.

The retainer 80 also has an internal annular groove 87 which mates with and cooperates with the underlying annular groove in the spout to house the garter spring 83. Again, as in the case of the two previously described embodiments, most of the force applied to the retainer 80 in operation will be applied against the retainer rings underlying counterbore 86. The garter spring 83 inserted through tapped hole 82 primarily prevents the retainer 80 from backing off the spout by moving axially inward along the nozzle body. The retainer 80 extends axially inward beyond the garter spring inserted through the tapped hole 82 and its underlying groove to prevent against wear of the spout adjacent the garter spring 83, which wear might otherwise allow the axial inward backing off of the retainer relative to the spout as described above.

Thus it is apparent that there has been provided, in accordance with the invention, a method and apparatus that fully satisfies the objects, aims, and advantages set forth above. While the invention has been described in conjunction with specific embodiments thereof, it will be evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. A fluid dispensing nozzle, said nozzle comprising:

a nozzle body, said body having an internal passageway, said body having an inlet and an outlet connecting said passageway;

means for selectively opening said internal passageway, said means allowing fluid flow between said inlet and said outlet;

a dispensing spout, said dispensing spout being operatively connected to said outlet;

a vapor recovery system, said system comprising:

a shroud, said shroud having means for sealing said shroud to a fill tank opening;

a passageway, said passageway being formed between said dispensing spout and said shroud; the improvement comprising:

means for securing said dispensing spout in said fill tank opening, said means comprising:

at least one annular groove, said annular groove being formed in said spout, said annular groove extending about said spout's peripheral surface;

at least one retaining ring, said retaining ring being fitted in said annular groove, said ring extending radially beyond said spout's peripheral surface;

a retainer, said retainer being fitted about said spout, said retainer being abutted against said retaining ring, said retainer engaging said fill tank opening, said retainer preventing fluid vapor from escaping said fill tank opening; and means for preventing axial movement of said retainer relative to said spout.

2. A dispensing nozzle as recited in claim 1 wherein said retainer is fitted over the retaining ring.

3. A dispensing nozzle as recited in claim 2 wherein said retaining ring is disposed between the abutting surface of the retainer and the discharge end of the spout.

4. A dispensing nozzle as recited in claim 3 wherein the retaining ring extends radially outward from the spout for approximately 0.025 inches.

5. A dispensing nozzle as recited in claim 4 further including a retainer nut threadably secured to the retainer, the retainer and the retainer nut being disposed on the spout on opposite axial sides of the retaining ring.

6. A dispensing nozzle as recited in claim 5 wherein the retainer has a first bore through which the spout extends and a counterbore, the counterbore having an internally threaded surface.

7. A dispensing nozzle as recited in claim 6 wherein the retainer nut has an exterior surface which is threaded to matingly interconnect with the interior threaded surface of the retainer.

8. A dispensing nozzle as recited in claim 7 wherein the retainer further includes a shoulder extending between the bore and the counterbore, the shoulder abutting the retaining ring.

9. A dispensing nozzle as recited in claim 8 wherein the retainer nut is disposed on the spout between the retaining ring and the spout's discharge end.

10. A dispensing nozzle as recited in claim 1 wherein the retainer includes a bore through which the spout extends and a counterbore on each of its axial ends and said spout includes two annular grooves.

11. A dispensing nozzle as recited in claim 10 wherein the diameter of one of the counterbores is greater than that of the other.

12. A dispensing nozzle as recited in claim 11 wherein the first of said counterbores has a diameter which is approximately equal to the diameter of the spout plus the thickness of the retaining ring and the second of the counterbores has a diameter which is smaller than the first counterbore by approximately the depth of the annular grooves.

13. A dispensing nozzle as recited in claim 1 wherein the spout includes two annular grooves and the retainer includes both a primary bore through which the spout extends and a counterbore in one of its axial ends with an annular groove in the primary bore, further including a retaining ring fitted in one of the annular grooves and abutted by a shoulder formed by said counterbore, the annular groove in the bore being in registry with the other of the annular grooves in the spout and forming an enclosure for a further retaining element, and a threaded hole extending radially through the retainer and into the retainer's annular groove.

14. A fluid dispensing nozzle, said dispensing nozzle comprising:

a nozzle body, said body having an inlet and outlet, said inlet and said outlet being operatively connected by an internal passageway;

means for selectively opening said passageway;

a discharge spout, said spout being operatively connected to said outlet, said spout having at least one annular groove, said groove extending about said spout's periphery;

at least one retaining ring, said ring being fitted in said groove, said ring extending radially beyond said spout's periphery;

means for retaining said discharge spout in a fill tank, said means being fitted about said spout, said means being abutted against said retaining ring, said means engaging a fill tank opening, said engagement operatively sealing the end of said fill tank when said means is inserted into said fill tank;

means for preventing axial movement of said means for retaining relative to said spout; and a vapor recovery system; said system comprising:

a shroud, shroud having means for sealing said shroud to a fill tank opening;

a passageway, said passageway being formed between said dispensing spout and said shroud.

* * * * *